US006209471B1

(12) United States Patent
Oomen

(10) Patent No.: US 6,209,471 B1
(45) Date of Patent: Apr. 3, 2001

(54) DOOR STRUCTURE

(75) Inventor: Hendrikus Willem Johannes Oomen, Ambt Delden (NL)

(73) Assignee: Mafo Holtkamp B.V. (NL)

( * ) Notice: Subject to any disclaimer, the term of this patent is extended or adjusted under 35 U.S.C. 154(b) by 0 days.

(21) Appl. No.: 09/379,950

(22) Filed: Aug. 24, 1999

(51) Int. Cl.[7] ..... B63B 19/00
(52) U.S. Cl. ..... 114/117
(58) Field of Search ..... 114/116, 117, 114/78, 201 R

(56) References Cited

U.S. PATENT DOCUMENTS 6,003,461 * 12/1999 Blanchette et al. ..... 114/117
6,009,669 * 1/2000 Jardine et al. ..... 49/316
6,059,230 * 5/2000 Leggett et al. ..... 244/129.5

* cited by examiner

*Primary Examiner*—Stephen Avila
(74) *Attorney, Agent, or Firm*—Webb Ziesenheim Logsdon Orkin & Hanson, P.C.

(57) ABSTRACT

Disclosed is a door structure including a door, a door opening in a bulkhead portion and a stiffening member extending peripherally in the door opening. The door is hingedly attached to a bulkhead portion and is movable between a position substantially covering the opening and a position substantially freeing the opening. The door includes a flat plate with peripheral edge zones, which extend to at least one of the stiffening member and the edge zones of the bulkhead portion bounding the opening. The distance between the peripheral edge zones and at least one of the stiffening member and the edge zones of the bulkhead portion is smaller than ¼ inch.

8 Claims, 6 Drawing Sheets

DOOR STRUCTURE

BACKGROUND OF THE INVENTION

The invention relates to a door structure, and more particularly to a door structure for ships with low Radar Cross Section requirements.

In order to make a ship invisible or nearly invisible to radar, a ship is build such, that when a radar beam irradiates the ship the reflection of said radar beam is directed away from the radar source, as a result of which the ship is not visible on the radar. However, radar is still further developed and smaller objects can be detected by radar. Traditional door structures, which are commonly used in such radar insensitive ships, still have protrusions and/or openings, which are particularly visible for radar, Any opening or recess larger than approximately ¼ inch is especially visible for radar and therefore the connection of the conventional door to the bulkhead is visible.

SUMMARY OF THE INVENTION

An object of the invention is to provide a door structure, which is in contrast to traditional door structures less or not visible for radar.

This object is achieved by a door structure according to the invention, which door structure includes a door, a door opening in a bulkhead portion and a stiffening member extending peripherally in said door opening, wherein said door is hingedly attached to said bulkhead portion and is movable between a position substantially covering said opening and a position substantially freeing said opening and said door comprises a flat plate with peripheral edge zones, which extend to at least one of said stiffening member and the edge zones of said bulkhead portion bounding said opening, wherein the distance between said peripheral edge zones and at least one of said stiffening member and said edge zones of said bulkhead portion is smaller than ¼ inch.

As a result of the flat plate there are no protrusions on said door, which can reflect the radar beam in the direction of the radar receiver. As the flat plate also extends to the edge zones of the bulkhead portion bounding said opening, this door structure according to the invention does not have any openings which would reflect the radar beam in the direction of the radar receiver.

In a preferred embodiment, the peripheral edge zones comprise a bent portion, which is bent towards said bulkhead portion, such that a distance between said peripheral edge zones and said bulkhead portions is reduced. Because of the flat plate, the radar reflection of radar beams, which irradiate the door structure in a substantially perpendicular direction, is reduced.

Flat vertical surfaces will reflect horizontal radar beams horizontally back to the radar source and this makes these surfaces visible to the radar source. Surfaces placed under an angle with the vertical, will return horizontal radar beams not to the radar source, where they become visible, but will direct the radar beams upwards and avoid the beams from reflecting horizontally to the source. This is an effective means to make large surfaces less—or invisibly for radar. Any openings or protrusions in the flat surfaces may reflect beams horizontally, back to the radar source and thus make these openings and protrusions visible. The current state of technology makes openings and protrusions smaller than ⅛ inch not or barely visible for radar.

A curved bent portion will always have a part which reflects the radar beam directly to the radar source and receiver. It is therefore preferred that the bent portion is substantially flat. However, due to manufacturing conditions it may be preferred to provide the peripheral edge zones with a beaded edge.

The invention can also be applied to the vertical opening that is normally visible between the two leaves in the middle of a double door. The invention also provides for the cover of this vertical opening and protrusion.

According to the invention, there is also a door structure provided, including two door sections wherein the edge zones of the flat plates facing each other are bent in a direction substantially perpendicular to the direction of said flat plate.

In this case, preferably the edge zones of the flat plates facing each other are bent in a direction substantially perpendicular to the direction of said flat plate and the distance between the facing edge zones is smaller than ¼ inch.

When a door structure is formed by two door sections, which can open independently of each other, it is necessary to reduce or eliminate the gap between the door sections. This can be done as described above, or by constructing the door sections such, that one door section overlaps another.

BRIEF DESCRIPTION OF THE DRAWINGS

The invention as said forth in the claims will become more apparent by reading the following detailed description in conjunction with the accompanying drawings, where like reference numerals refer to like parts throughout the drawings, in which:

DESCRIPTION OF THE PREFERRED EMBODIMENTS

Figure 1:
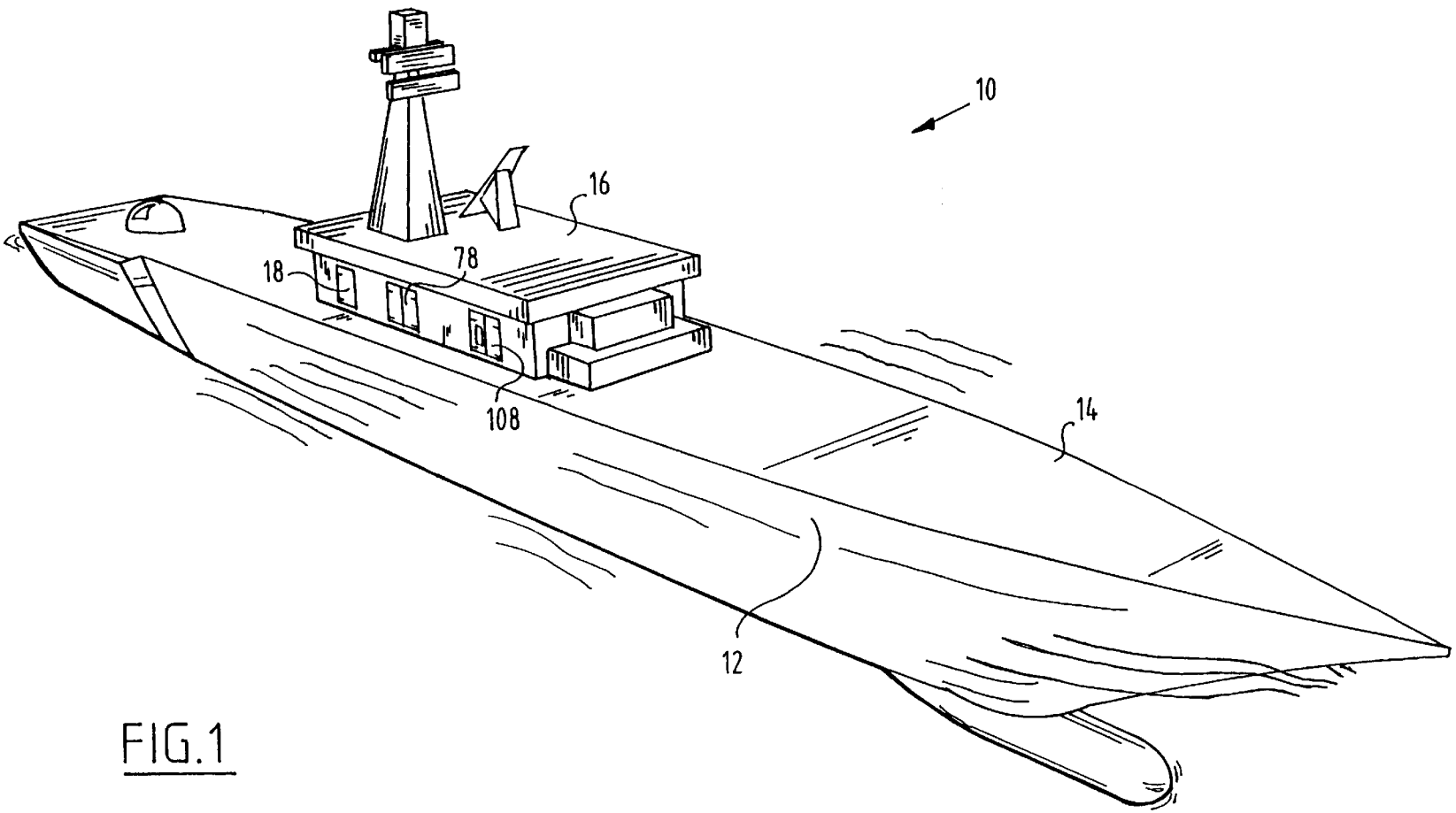
FIG. 1 shows a perspective view of a ship, provided with door structures according to the invention.

FIG. 1 shows a ship 10 with a hull 12, a deck 14 and a superstructure 16. The superstructure 16 has several door structures 18, 78, 108 according to the invention. The ship 10 has preferably been designed to be invisible for radar. The design criteria are common knowledge in the art and include for example special angles of bulk head plates or the use of special materials.

Figure 2A:
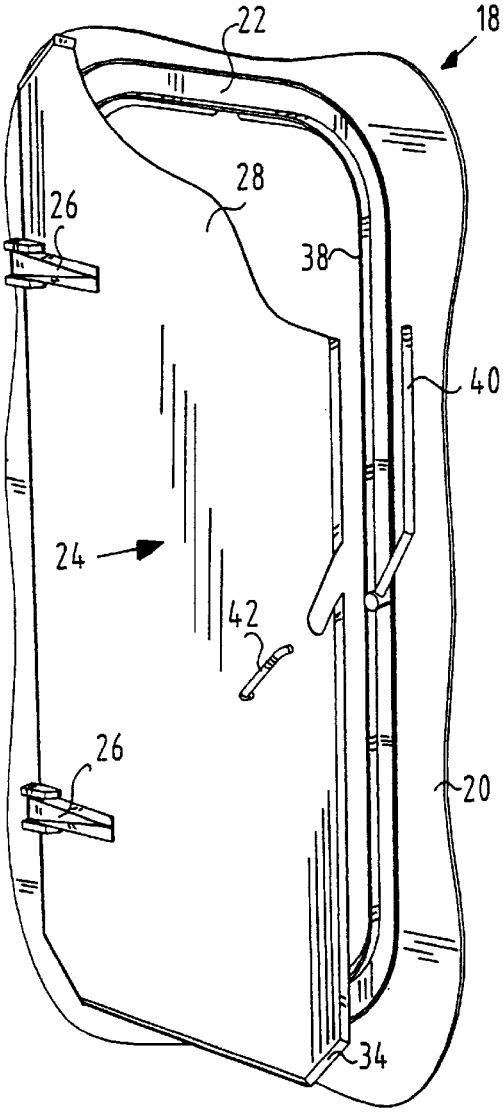
FIGS. 2*a,* 2*b* and 2*c* show a first embodiment of a door structure according to the invention.
Figure 2B:
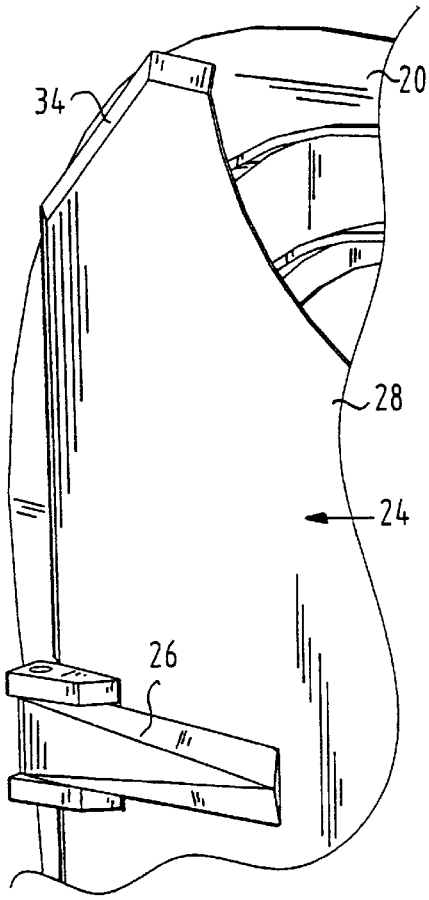
Figure 2C:
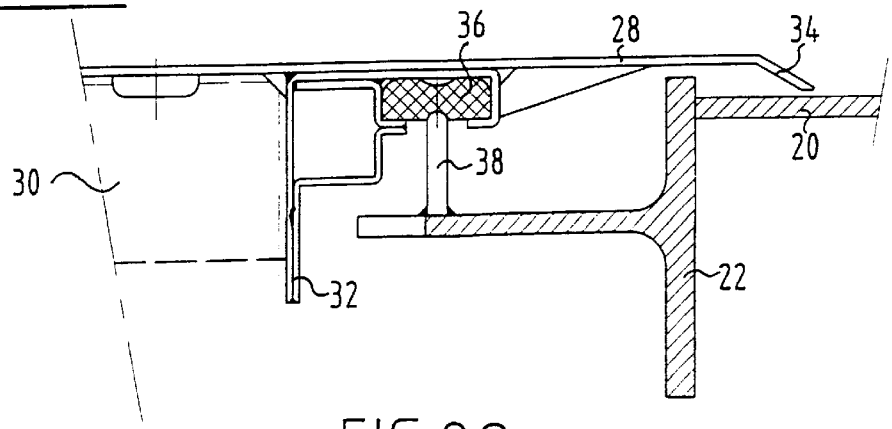

FIGS. 2*a*–2*c* show a first preferred embodiment of a door structure 18 according to the invention. This door structure 18 is arranged in an opening in a bulkhead portion 20. In order to strengthen the opening in the bulkhead portion 20 and to facilitate the installation, a strengthening member 22 with a T-shaped cross section is welded in the opening. A door panel 24 is hingedly attached to the frame 22, which is welded into the bulkhead 20 of the ship, by means of hinges 26.

The door 24 consists of a flat plate 28, which is strengthened by web plates 30 and a frame portion 32.

The peripheral edge 34 of the flat plate 28, is bent, substantially flat and extends over the frame 22 towards the bulkhead portion 20. As a result, the flat plate 28 covers the whole opening in the bulkhead portion 20.

In the frame portion 32, a gasket 36 is arranged, which cooperates with a knife blade 38, which extends peripherally from the frame 22. In a closed position of the door 24 the gasket 36 and knife blade 38 provide a watertight closure of the opening.

Furthermore, the door structure 18 comprises a conventional bolting mechanism, which can be manually operated by a handle 40. The door 24 has a grip 42 in order to be able to manually put the door 24 in a open or closed position.

Although the handle 40, the grip 42 and the hinges 26 are arranged on the outside of the door and will increase the visibility for radar, they are constructed in this way as a result of other construction requirements, like that a door should be operable from the outside.

Figure 3A:
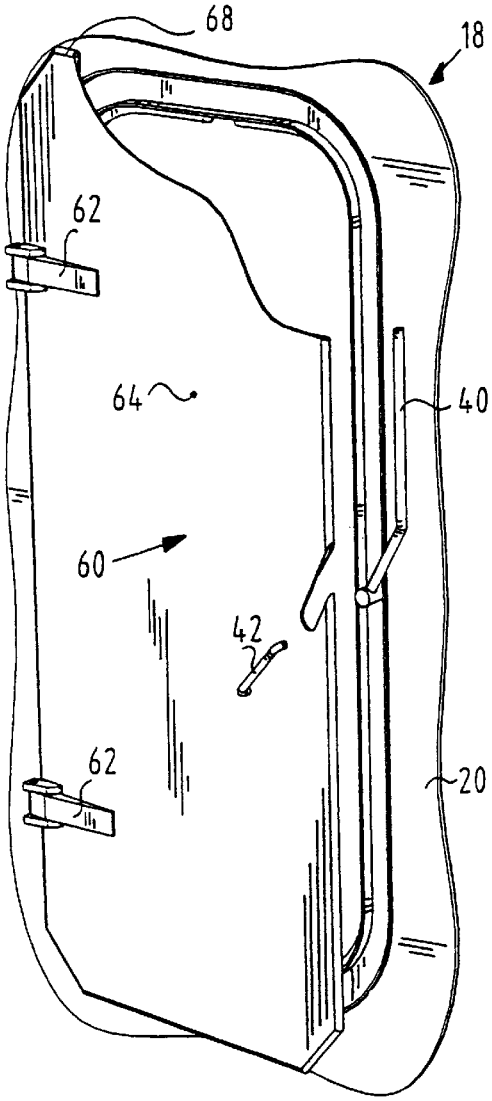
FIGS. 3*a,* 3*b* and 3*c* show a second embodiment of the invention.
Figure 3B:
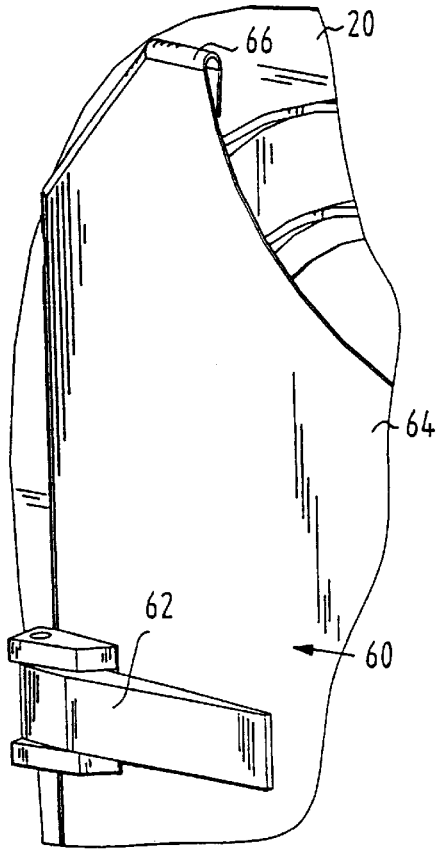
Figure 3C:
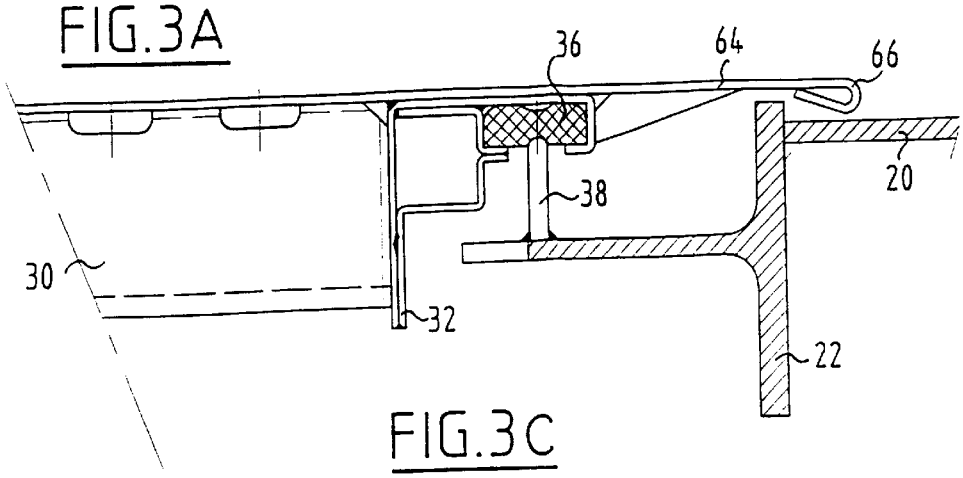

FIGS. 3*a*–3*c* show a second embodiment according to the invention, which is similar to the first embodiment. Corresponding parts of the door structure 18 are referenced by the same reference numerals and are not described further.

This door structure has a door 60, which is hingedly attached to the bulkhead portion 20 by hinges 62. The door 60 has a flat plate 64, which is strengthened by web plates 30 and a frame portion 32. The edges of the flat plate are beaded.

Preferably, the distance between the beaded edge 66 and the bulkhead portion 20 is smaller than ¼ inch.

Figure 4A:
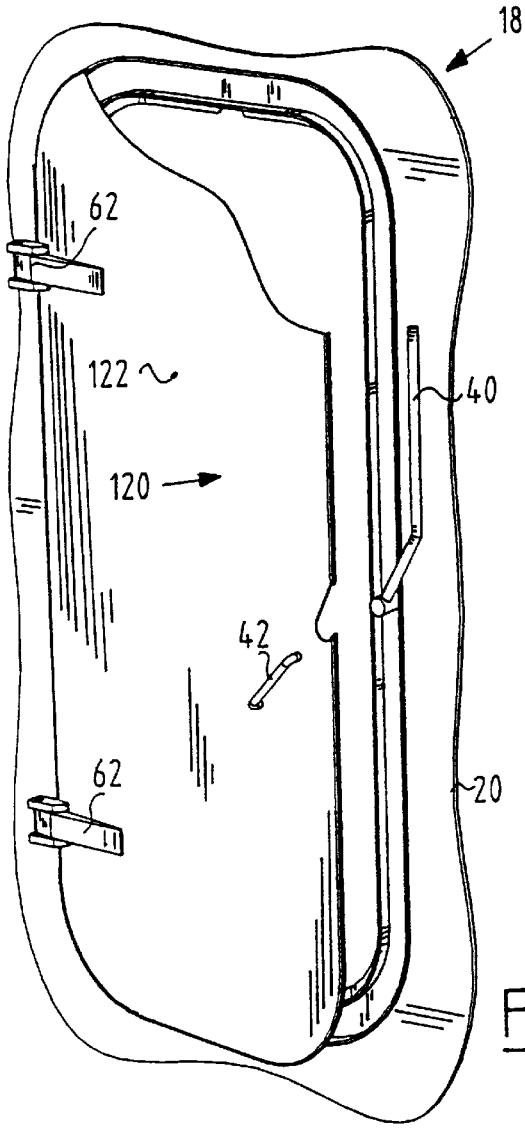
FIGS. 4*a,* 4*b* and 4*c* show a third embodiment of the invention.
Figure 4B:
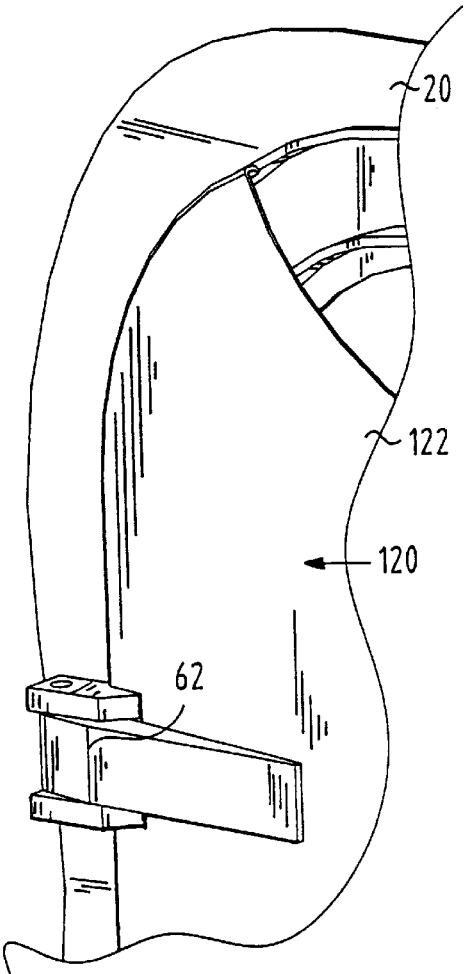
Figure 4C:
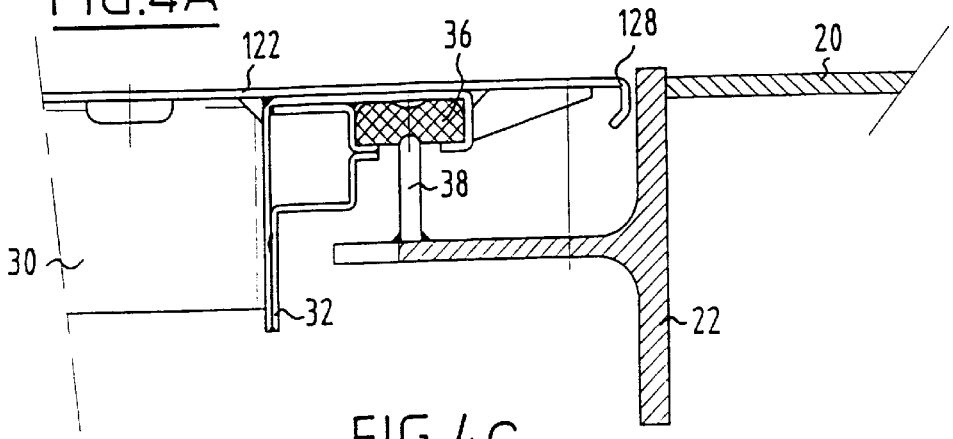

FIGS. 4*a*–4*c* show a third embodiment of the invention. This embodiment is similar to the second embodiment according to FIGS. 3*a*–3*c*. Similar parts are referenced by the same reference numerals and are not described further.

The door 120, which is hingedly attached to the bulkhead portion 20 by hinges 62 has a flat plate 122, which is strengthened by web plates 30 and a frame portion 32. The peripheral edges 128 of the flat plate 122 extend to the strengthening member 22. Preferably the distance between the peripheral edge 128 and the strengthening member 22 is less than ¼ inch.

Figure 5A:
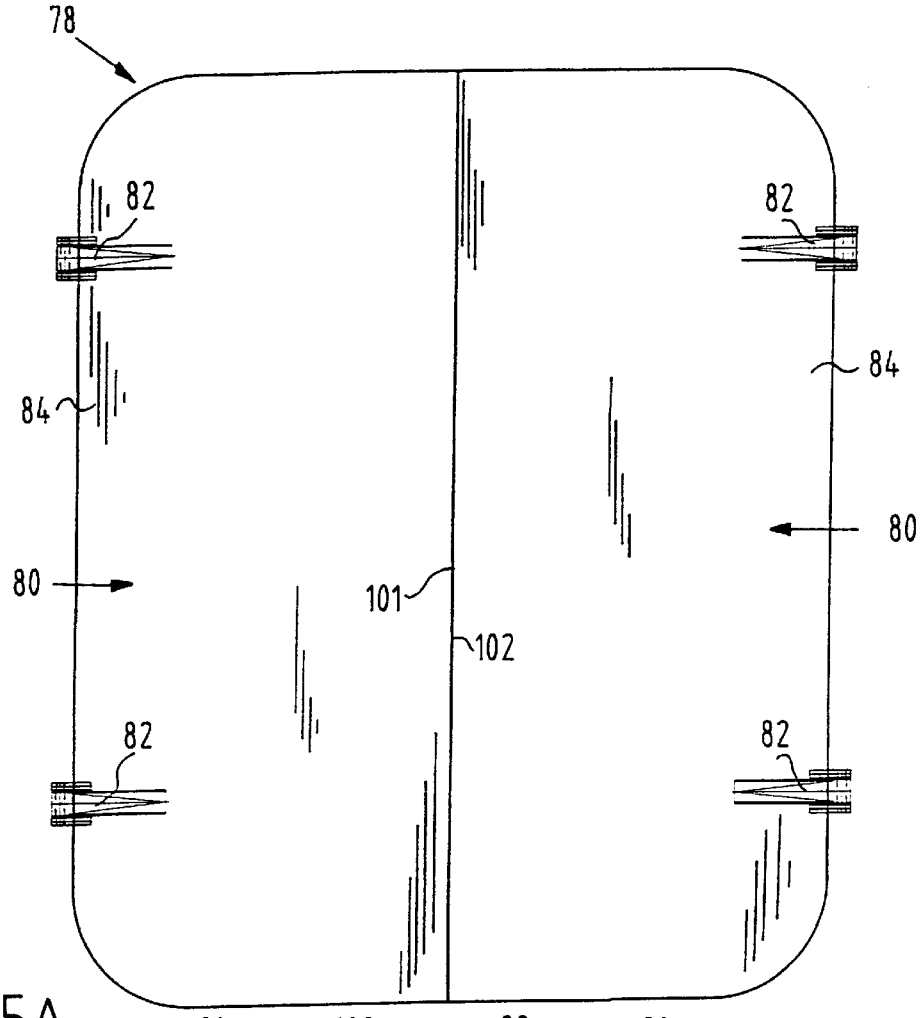
FIGS. 5*a,* 5*b* and 5*c* show a fourth embodiment of the invention.
Figure 5B:
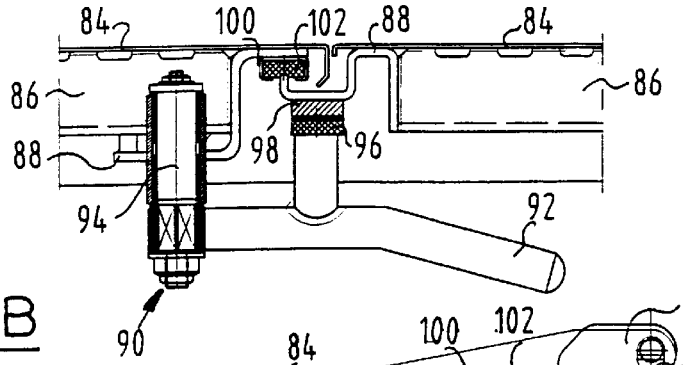
Figure 5C:
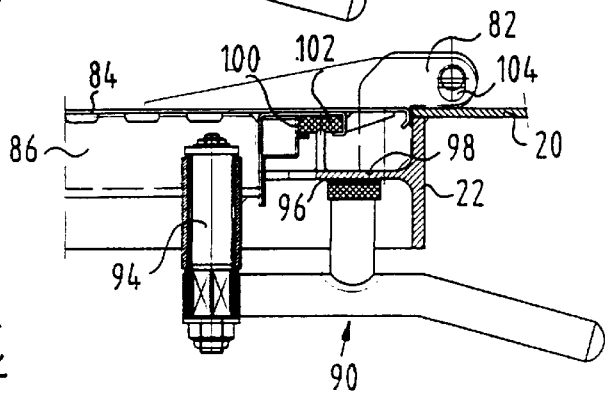

FIGS. 5*a*–5*c* show a fourth embodiment of a door structure 78 according to the invention. This door structure 78 is a double door with two door panels 80, which are each hingedly attached to the bulkhead portion 20 by hinges 82. Each door section 80 has a flat plate 84, which is strengthened by web plates 86 and a frame portion 22 on the outer periphery of the door. The facing edges 101, 102 of the flat plates 84 are bent and the distance therebetween is preferably less than ¼ inch.

On the inside of the door structure 78, several bolting mechanisms 90 are arranged in order to bolt the door sections 80 in a closed position. Each bolting mechanism 90 has a handle 92, which is rotatably arranged in the frame portion 88 by a bearing 94. The handle 92 has a wedge like part 96, which cooperates with a wedge like part 98, which is arranged on the frame portion 88. When operating the bolting mechanism 90, the wedge like parts 96, 98 are shifted along each other, as a result of which a knife plate part 100 is pressed into a gasket 102. The hinges 82 are provided with a elongated slot to enable the hinge 82 to have a small displacement, in order to ensure a good cooperation between the knife plate part 100 and gasket 102 near the hinges 82.

Similar bolting or dogging mechanisms may be used on other positions and/or other types of door structures according to the invention.

Figure 6:
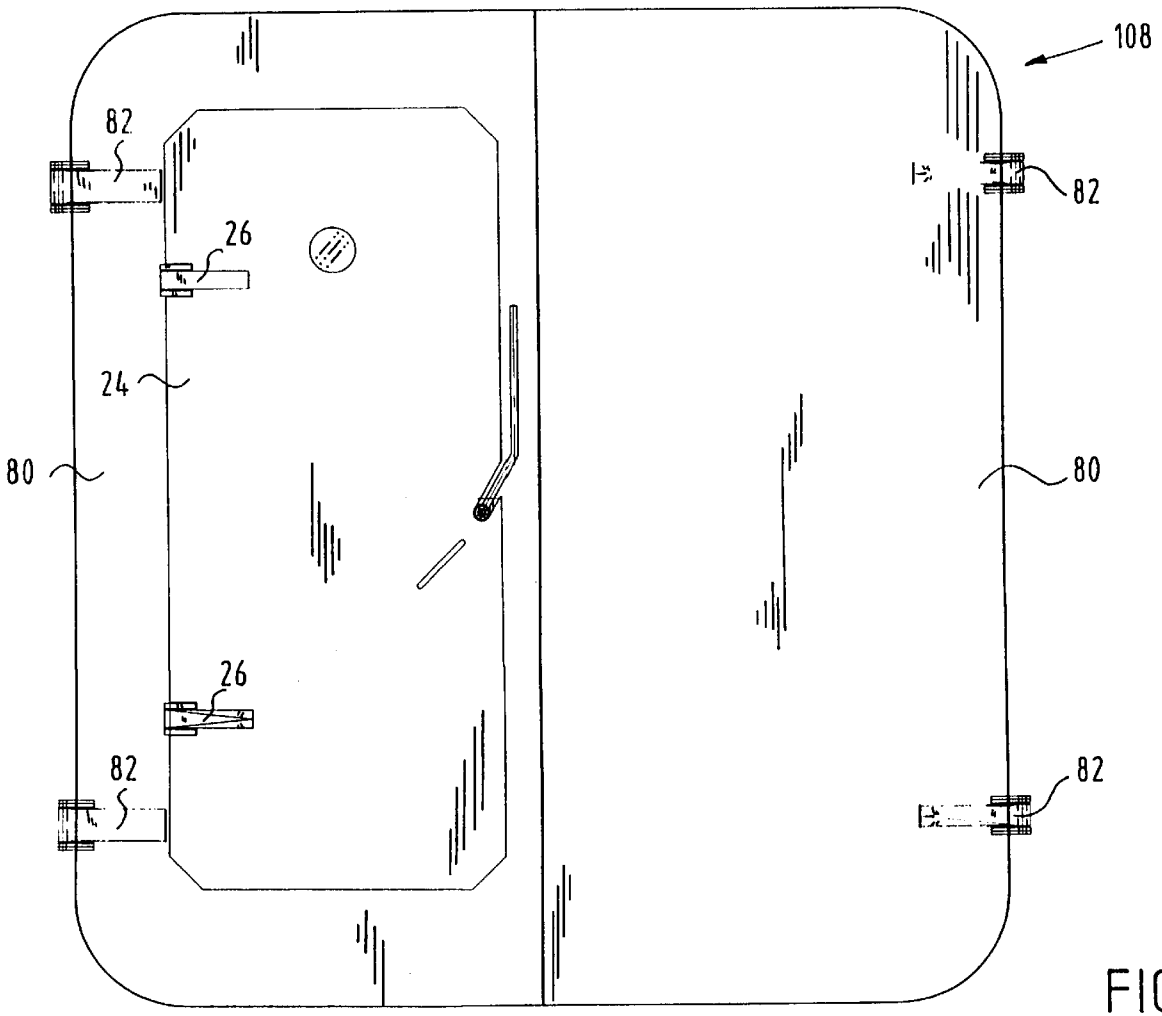
FIG. 6 shows a fifth embodiment of the invention.

FIG. 6 shows a fifth embodiment of a door structure 108 according to the invention, which is a combination of the third preferred embodiment according to FIGS. 4*a*–4*c* and a door structure according to FIGS. 2*a*–2*c* or FIGS. 3*a*–3*c*, in which the bulkhead portion 20 is formed by a door section 80.

With reference to the drawings it is note that FIGS. 2, 3 and 4 show three alternative arrangements and structures for eliminating the described radar reflecting properties of openings in single door structures. FIGS. 5 and 6 show that these three different structures can also be used in double door structures and in "door-in-door" structures, respectively.

What is claimed is:

1. A door structure including a door, a door opening in a bulkhead portion and a stiffening member extending peripherally in said door opening, wherein said door is hingedly attached to said bulkhead portion and is moveable between a position substantially covering said opening and a position substantially freeing said opening and said door comprises a flat plate with peripheral edge zones, which extend to at least one of said stiffening member and the edge zones of said bulkhead portion bounding said opening, wherein the distance between said peripheral edge zones and at least one of said stiffening members and said edge zones of said bulkhead portion is smaller than ¼ inch, wherein said peripheral edge zones of said flat plate extend over the edge zones of said bulkhead portion bounding said opening.

2. The door structure according to claim 1, wherein said peripheral edge zones comprise a bent portion, which is bent towards said bulkhead portion, such that the distance between said peripheral edge zones and said bulkhead portion is reduced.

3. The door structure according to claim 1, wherein the distance between said peripheral edge zones and said bulkhead portion is smaller than ¼ inch.

4. The door structure according to claim 2, wherein said bent portion is substantially flat.

5. The door structure according to claim 1, wherein said peripheral edge zones comprise a beaded edge.

6. A door structure including two door sections, a door opening in a bulkhead portion and a stiffening member extending peripherally in said door opening, wherein said door sections are hingedly attached to said bulkhead portion and are each moveable between a position substantially covering a respective part of the opening and a position substantially freeing said respective part of the opening and each door section comprises a flat plate with peripheral edge zones, which extend to at least one of said stiffening members and the edge zones of said bulkhead portion bounding said respective part of the opening, wherein the distance between said peripheral edge zones and at least one of said stiffening members and said edge zones of said bulkhead portion is smaller than ¼ inch, wherein the edge zones of the flat plates facing each other are bent in a direction substantially perpendicular to the direction of said flat plate and wherein the distance between the facing edge zones is smaller than ¼ inch.

7. The door structure according to claim 6, wherein at least one door section comprises a structure including a door, a door opening in said door section and a stiffening member extending peripherally in said door opening, wherein said door is hingedly attached to said door section and is movable between a position substantially covering said opening and a position substantially freeing said opening and said door comprises a flat plate with peripheral edge zones, which extend to at least one of said stiffening member and the edge zones of said door section bounding said opening, wherein the distance between said peripheral edge zones and at least one of said stiffening member and said edge zones of said door section is smaller than ¼ inch.

8. A door structure including a door, a door opening in a bulkhead portion and a stiffening member extending peripherally in said door opening, wherein said door is hingedly attached to said bulkhead portion with a plurality of hinges and is movable between a position substantially covering said opening and a position substantially freeing said opening and said door comprises a radar reflecting flat plate with peripheral edge zones, which extend over the edge zones of said bulkhead portion bounding said opening and comprise a substantially flat bent portion, which is bent towards said bulkhead portion, such that a distance between said peripheral edge zones and said bulkhead portion is smaller than ¼ inch, a plurality of web plates extending across said flat plate, a peripheral gasket arranged to said peripheral edge zones, which cooperates in the covering position with a peripheral knife blade extending perpendicularly from said stiffening member, and a bolting mechanism for bolting said door in the covering position and urging said peripheral gasket onto said knife blade.

* * * * *